US006543158B2

(12) United States Patent
Dieckhaus

(10) Patent No.: US 6,543,158 B2
(45) **Date of Patent: *Apr. 8, 2003**

(54) FOOTWEAR INSOLE INSERT

(75) Inventor: Wayne R. Dieckhaus, Gasconade County, MO (US)

(73) Assignee: Walk Easy Manufacturing, Inc., Owensville, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/766,964

(22) Filed: Jan. 23, 2001

(65) Prior Publication Data

US 2001/0001351 A1 May 24, 2001

Related U.S. Application Data

(63) Continuation of application No. 09/349,207, filed on Jul. 7, 1999, now Pat. No. 6,195,917.
(60) Provisional application No. 60/092,246, filed on Jul. 10, 1998.

(51) Int. Cl.[7] ..... A43B 13/38; A43B 23/00
(52) U.S. Cl. ..... 36/44; 36/154; 36/93
(58) Field of Search ..... 36/43, 44, 93, 36/154

(56) References Cited

U.S. PATENT DOCUMENTS

| | | | | | |
|---|---|---|---|---|---|
| 3,895,405 | A | * | 7/1975 | Edwards | 12/146 M |
| 4,099,342 | A | * | 7/1978 | Singh | 36/44 |
| 4,151,660 | A | * | 5/1979 | Yoshimi et al. | 36/44 |
| 4,413,429 | A | * | 11/1983 | Power | 36/44 |
| 4,729,179 | A | | 3/1988 | Quist, Jr. | |
| 4,782,605 | A | | 11/1988 | Chapnick | |
| 4,942,679 | A | | 7/1990 | Brandon et al. | |
| 5,003,708 | A | | 4/1991 | Daley | |
| 5,203,793 | A | | 4/1993 | Lyden | |
| 5,204,173 | A | | 4/1993 | Canary | |
| 5,216,825 | A | * | 6/1993 | Brum | 36/44 |
| 5,388,349 | A | | 2/1995 | Ogden | |
| 5,544,432 | A | | 8/1996 | Kita | |
| 5,718,064 | A | | 2/1998 | Pyle | |
| 5,727,336 | A | | 3/1998 | Ogden | |
| 5,733,647 | A | * | 3/1998 | Moore, III et al. | 36/44 |
| 6,195,917 | B1 | | 3/2001 | Dieckhaus | |

* cited by examiner

*Primary Examiner*—M. D. Patterson
(74) *Attorney, Agent, or Firm*—Paul M. Denk

(57) ABSTRACT

An insole insert for application into a shoe, and which is formed as a laminar material of various layers of paper, polymer, stranded thermoplastic or thermosetting material, foams of select consistencies and texture, in addition to a felt or microfiber type of upper layer, to add to the cushioning and softness of the insert, when applied. The insert, when subjected to heat and pressure, particularly pressure applied by the foot, conforms to the contours of the foot, and sustains such, even after prolonged usage after application into a shoe.

5 Claims, 1 Drawing Sheet

FOOTWEAR INSOLE INSERT

This application is a continuation of the application having Ser. No. 09/349,207, filed Jul. 7, 1999, which claims priority to provisional application having Ser. No. 60/092,246, filed on Jul. 10, 1998, now U.S. Pat. No. 6,195,917.

BACKGROUND OF THE INVENTION

The essence of this invention is the provision an insole insert, which is applied into the interior of a shoe, similar to that of a sock liner, but which incorporates unique characteristics that allow the insert to conform and thermoset to the configuration of the foot of the particular wearer of the shoes, sustain that determined contour, in order to enhance the general wear, comfort and duration of the liner, when used in conjunction with the personal shoes of the wearer.

A variety of different types of footwear inserts have long been available in the art, and which are generally provided for the purpose of adding comfort to the interior of the shoe, and as a means for overlying the insole, particularly in those styles of shoes that may use a hardening adhesive in order to apply these types of components to the shoe upper, or in the case of dress shoes, where nails may still be utilized for applying soles to the footwear, during their fabrication. More specifically, in the construction of boots, unless the sole is molded in situ to the boot upper, during its fabrication, nails are generally used for adhering the outsoles to the boots, during their fabrication. Hence, when these types of hard and roughened edges are disposed interiorly of the insole, it becomes necessary to provide a form of sock liner, to the interior of the shoe, in order to add to its comfort, and to shield the foot from exposure to these types of footwear assembly components.

In addition to the foregoing, it becomes desirable to add a form of insert into the shoe, that may not only provide for comfort, but which may further add to the orthopedic support for the foot, when such fabricated shoes are worn in which the insole insert of this invention may be applied.

Examples of prior art types of insoles can be seen in various previous patents that have issued, such as in the patent to Quist, Jr., U.S. Pat. No. 4,729,179, upon a shoe insole. As can be seen, this patent does show a shoe insole, which amongst its various layers of foam, also includes a metal layer, as can be noted. This particular insole is designed to provide for rugged protection against the foot, through the addition of the metal layer, and that the remaining layers of foam, polyethylene film, and felt, are obviously present for comfort purposes.

The patent to Chapnick, U.S. Pat. No. 4,782,605, describes a shoe insert construction and method of making the same. While the insert of this particular patent may include that one of its layers is formed of a high density material, that functions as a support layer, it does not appear that this particular layer has any memory to it.

The patent to Brandon, et al, U.S. Pat. No. 4,942,679, shoes a styled comfort shoe construction. The insole for this particular designed shoe also includes a variety of layers of foam material, leather lining, and other filler materials, in which are cement-lasted to the shoe, but once again, it does not appear that any of these layers or foam or otherwise material have any memory function to them.

The patent to Dailey, U.S. Pat. No. 5,003,708, shows a custom insole for an athletic shoe. This particular insole is more concerned with providing a significantly sized arch flange, as can be seen, but some of these flanges, or portions of the custom insole, are made of thermaformable materials.

But, the method of making the insole of this prior patent would appear to be performed under a procedure that is different from that of the current invention.

The patent to Lyden, U.S. Pat. No. 5,203,793, shows a conformable cushioning and stability device for articles of footwear. While this particular patent does describe a conformable material which apparently achieves a solid matter state, after a working time, in order to enhance its comformance, the cushioning means is fabricated containing a variety of other components, such as a resilient layer of fluid material, in addition to a void that contains gas. This is not of similar construction to the insole insert of this current invention.

The patent to Canary, U.S. Pat. No. 5,204,173, discloses a paperboard product and process. While the paperboard product, as laminated, may be used for making shoe insoles, none of the other layers of material are that related to the design of the current invention.

The patent to Ogden, U.S. Pat. No. 5,388,349, shows another footwear insole. This insole is defined as comprising an apertured top layer, for thermoconductive purposes, even though formed of thermoplastic material, but designed for different usage than that of the fabricated insole of the current invention. This particular insole, of this prior art patent, includes a first layer that is slip resistant, a non-absorbent, and thermally non-conductive component in its structure. None of the layers of this insole are defined for use for contouring purposes, that have memory for undertaking and holding the shape of the foot, once heated and applied.

The patent to Kite, U.S. Pat. No. 5,544,432, shows an insole for shoes providing heel stabilization. This particular device simply includes means for heel stabilization, through the usage of an inner fabric layer, a side wall portion, and a cushioning material, which is apparently formed of some type of resilient putty particles, apparently for conformance purposes.

The patent to Pyle, U.S. Pat. No. 5,718,064, is upon a multi-layer sole construction for walking shoes. This is a multi-layered insole, and it does contain a sock lining having a layer of shock absorbing material, in addition to a latex layer that is formed of humidity and odor absorbing material, including carbon particles, in addition to an upper layer that is of an open celled foam, and ergonomic of design. This liner does include a foam layer, having a latex layer applied thereto, and which contains a plurality of carbon particles, and includes a foam layer of medium density having the ergonomic abilities, to provide high energy absorption.

The patent to Ogden, U.S. Pat. No. 5,727,336, shows a footwear insole with a moisture absorbent inner layer. This particular patent is very similar to, and comprises a continuation upon, the earlier Ogden U.S. Pat. No. 5,388,349. The insole of this particular patent is also formed in a related manner, having a first layer of slip-resistant material, and which is not absorbent, and includes thermally non-conductive attributes, within its structure.

These are the various prior art known to the applicant, and which, upon review, do not appear to incorporate either directly, or by suggestion, the components of this current invention as will be subsequently described.

SUMMARY OF THE INVENTION

This invention relates generally to a footwear insert, and more specifically an insole insert that not only adds comfort to the shoe, when worn, but contains an attribute that allows for the insert to conform instantaneously to the contours of the foot, in order to further add to the comfort, and customized application of the shoe to the foot, once the insole insert of this invention is treated, applied, for continuing wear.

This invention contemplates formation of an insole insert, that may be applied into a shoe, either at the sight of manufacturing, or by the end retail customer, and which insert, when heated, and the foot is applied thereto, with some degree of pressure, conforms to the shape of the foot, to add to the comfort and convenient usage of the shoe, making it a rather customized form of footwear for its user. In addition, as the various contours of the foot may vary, the insert of this invention may be reheated, for repeat usage, to undertake conformance once again to the shape of the foot, and reinserted, for continuing usage.

This invention basically includes a footwear insert, which is related to a sock liner, and which includes various layers of applied material, including a bottom layer of an outer more resistant material, in this particular instance, identified as Bond-Tex, and which is a type of paper, polymer, or of other composition, to add reinforcement to the bottom of the insert, during its fabrication. Furthermore, it is this layer of material that may be applied, by adhesive, if necessary, when the insert is added to the interior of the shoe. The second layer of material, embodied in the insert of this invention, is a layer of threaded material, believed to be woven from thermoplastic polymer, and it is this thin layer of material which is of a moldable characteristic, which when subjected to heat, and pressure, undertakes the shape of the mold applied to it, such as the undersurface of the foot, when this insert is applied into a shoe, after being heated, such as from the microwave, and the pressure of the foot is applied to it, to fix it at the desired contours of the foot, during installation. This particular layer of material is very lightweight, and when subjected to heat activation, allows the entire insole to conform to the fit of the insole of the foot of the customer, when used. Thus, it is this particular layer that dictates the shape of the entire insert, once it has been subjected to pressure, and holds the insert into that contoured configuration, once applied. The third layer of material added to this insert includes a closed cell polymer foam, provided to add a little more resistance, to the resiliency of the insert, and to further act as a cushioning against more heavy impact loads, such as when the wearer may jump upon the ground, as during an athletic endeavor, or the like. This is nitrate type of foam, and it is used for shock absorbing purposes, and to allow the insert to have some stretch to it, during application. The next layer of material embodied within this insert is identified in the trade as Poron, and this is a form of urethane foam, and which adds resiliency, cushioning, and comfort to the insert, during its routine application and usage. It is a soft layer of material, it is microfiber type of sock liner material, forming a defined fiber surface to the insert, in order to provide cushioning, softness, and comfort to the wearer, when it is glued onto the upper surface of the Poron material.

It is these components that make up the concept of this invention, they are a form of laminar material that may either be molded together, during their processing, or select components may be adhesively secured together, in order to form a unitary form of sock liner, functioning as an insole insert, but which can be treated with heat and pressure in order to add curvature to its configuration, during application.

It is, therefore, the principal object of this invention to provide an insole insert that can be treated to conform, and permanently sustain, contours assimilating the bottom surface of the foot, when applied into the shoe of its wearer.

Another object of this invention is to provide a comformable insole insert which when subjected to heat and pressure undertakes the configuration of the undersurface of the sole of the foot, for enhanced comfort and orthopedic support to the foot when the shoe is worn.

Another object of this invention is to provide an insole insert which while once treated to provide its conformity to the foot of the wearer, may be further subjected to heat and pressure for recontouring as such becomes necessary.

Still another object of this invention is to provide an insole insert which when subjected to heat, in the category of microwave energy, or other forms of heat application, and which when subjected to the pressure of the bottom of the foot, thermoelastically undertakes the contours of the bottom surface of the foot for support purposes.

Another object of this invention is to provide an insole insert which while providing the benefits as explained herein, further includes attributes that enhance the moisture wicking of the insert, is abrasion resistant, is comfortable to the wearer, is shock absorbing, adds rebound, is impact resistant, and affords enhanced stability to the foot, when the shoes in which the insert is applied or worn.

A further object of this invention is to provide enhanced moldability to an insole insert when used.

These and other objects may become more apparent to those skilled in the art upon reviewing the summary of this invention, and upon undertaking a study of the description of its preferred embodiment, in view of its illustrative drawings.

DESCRIPTION OF THE PREFERRED EMBODIMENT

Figure 1:
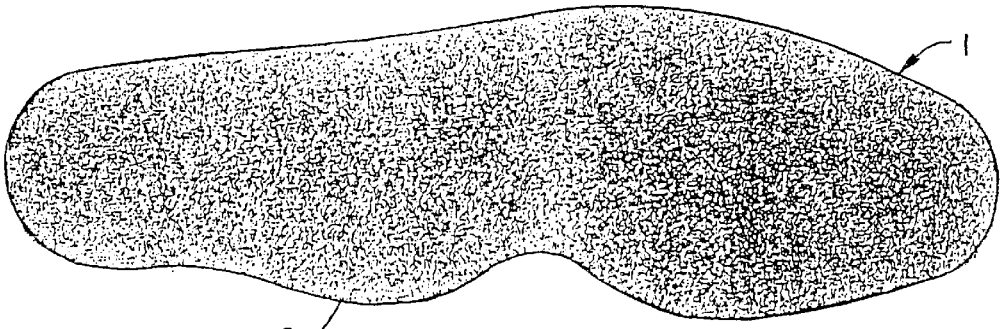
FIG. 1 is a plan view of a full length insole insert of this invention.
Figure 2:
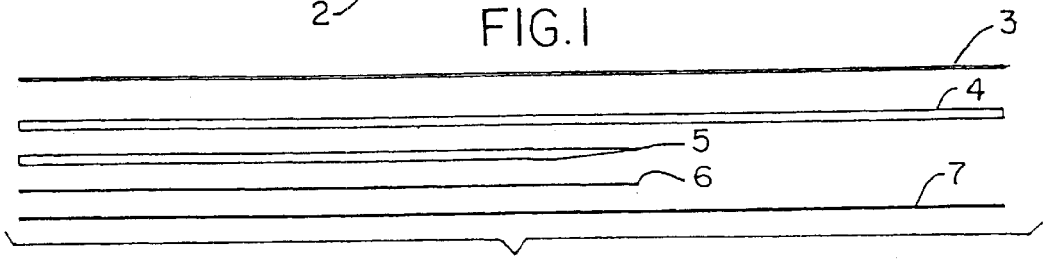
FIG. 2 is an exploded view of various laminar layers that make up the insole insert of FIG. 1.

In referring to the drawings, and in particular FIG. 1, the insole insert 1 of this invention is readily disclosed, in its plan view, and as can be seen, it generally undertakes the shape and configuration of the bottom of the foot, at least from peripheral standpoint, having the arch support 2 that extends laterally from one side, as is customary in shoe fabrication. The particular components that make up the insert of this invention are shown in FIG. 2. These components include, as previously summarized, a top layer 3 that is worn closest to the foot, which is formed of a fabric material, generally as a soft layer of material, and it is a microfiber type of sock liner, comprising a form of defined fiber formed to provided cushioning, softness, and which is then glued onto the upper surface of the insert, during its fabrication. Almost any soft material may be useful for this purpose, and for forming the upper layer of this liner. This microfiber material is generally available in the art, under the trade name San Fong, and can be purchased under Model No. KS 9006, from S.F.S. Associates, Inc., located at 5450 Highland Park Dr., St. Louis, Mo. 63110.

This particular microfiber sock liner material certainly adds comfort to the sock liner, during its application, it provides a very pleasing appearance, in the preferred embodiment, is formed as a brown or tan colored soft layer, but obviously, other attractive colors can be utilized for the same purpose. It is highly abrasion resistant, particularly as the foot is continually slid into or removed from the shoe, during repeat and continuous applications. This material, being a form of woven fabric, woven of blank threads, or having a flocked consistency applied to its upper surface, is also moisture wicking in order to reduce and minimize the moisture of the foot, for hygenic purposes. Also, said material will have stretch capabilities.

The second layer of material, from the top is a form urethane type of foam, available in the art under the trademark Poron, under Model No. 9400, and is available from Rogers Corp., located at East Woodstock, Conn. 06244, as required. It also is a cushioning form of urethane, as at 4, which is shock absorbing, has rebound to it, to add to the resiliency and comfort of the shoe. In addition, it is impact resistant, particularly when the insole insert of this invention may be applied into an athletic or walking shoe. In addition, it does have enhanced stability, even after repeat usage, such as when shoes, in which the insert of this invention may be applied, may be used daily by the wearer. This Poron product provides stability and durability, to the shoe, along with comfort, when applied in a sock liner. This material has a slow recovery when pressure is applied to it, and which when compressed forms to the foot, yet when released, returns to its original shape, during application. This particular resilient material also provides resistance against extra shock and load, and provides support to the heel area of the foot, which benefits the overall insole, when used.

This layer of Poron material is applied to the upper layer microfiber sock liner material, through the use of a water base formulated adhesive, that is compatible to both products. This adhesive may be obtained from Midwest Industrial Chemical, located at 1509 Sublette, St. Louis, Mo. 63110, under the name "23-20-8."

The third from the top layer of material, as at 5, applied and laminated into the structure of the insole insert of this invention includes a closed cell foam, which is generally identified as an SCC type of foam, and is readily from Rubbertire, Inc., located at 2501 Guyan Avenue, Huntington, W.Va. 25703. This closed cell foam has a little firmer texture to its constituency, it adds additional cushioning to the insert at its back half, as can be seen, it is likewise shock absorbing, and does have some ability to provide foot memory, due to contouring from repeat usage of the shoe in which this insert is applied. This particular closed cell foam layer is also impact resistant, and has sufficient firmness in order to withstand heel strikes, repeatedly, and to add support to the heel, when the shoe is used especially during athletic endeavors.

The fourth layer 6 from the top adds the essence to this invention with respect to providing moldability and contour memory to the insert, as fabricated. This is the woven layer 6, as indicated in FIG. 2, and this is a thermoplastic form of strand woven fabric, that is applied into this insert, and which when subjected to heat, and pressure, can undertake the particular configuration of the molding component applied to it, such as the foot of the wearer, during usage and installation. The particular material has thermoplastic attributes, inherent of its woven polymer treated strands, and which when subjected to heat, in the range of 130° F. to 190° F., and preferably at 150° F., can immediately have pressure applied to it, such as the bottom of the foot of the wearer, when the insert has been added into a shoe. The particular material forming this component is of a cotton or nylon texture, formed as strands, and which appears to be polymer saturated so as to provide the strands, in their fabric-like woven consistency, with thermoplastic capabilities. Microwaving the insert up to about a minute, or for about 25 to 30 seconds, works satisfactorily to prepare the insole for contouring. By subjecting the insert to sufficient pressure, in the category of the weight of the shoe wearer, conforms the woven strands, when cooled, to undertake a permanent configuration corresponding to the curvature of the underside of the foot, during said application. And, because the strands are fabricated as thermoplastic, when the insert is removed from the shoe, and subsequently subjected to additional heat, in the range as previously described, and reinserted back into the shoe, it once again undertakes fixation at the newly applied contours of the foot, during this reapplication. All this provides individual fitting of this insole to the foot. Although, it is just as likely that the strands of this woven material for this insert may be thermosetting, rather than thermoplastic, so that once the insole is heated, and subjected to the pressure of the foot, initially, it will undertake a particular contour of that foot, and hold the same, throughout its duration and usage within a shoe. This particular polymer woven material is available under the Model No. R-3103, and identified under the trademark STANBEE, and can be obtained from Stanbee, Inc., located at 70 Broad Street, Carlstadt, N.J. 07072. Such woven material may be obtained to various consistencies, and densities, depending upon the type of insole insert in which the material may be applied, during fabrication of the insert, and further depending upon the rigorousness to which the shoes, in which this insole is to insert, may be used, under the circumstances. For example, for regular business shoes, perhaps a lesser density fabric material may be employed. But, for walking shoes, or athletic shoes, in the category of jogging shoes, football or soccer shoes, basketball shoes, or the like, a heavier density type of laminar fabric, for use for this purpose, may be employed, as required. The use of this material, as stated, is to add to the moldability of the insert, once applied, and likewise, to further add to the heel support, and arch support, of the footwear user, during application.

The final layer 7, or the bottom layer of the insert, and which is applied to the underside of the R-3103 woven fabric, is a bottom layer of a paper or polymer composition, it is generally identified in the market under the trade name Bond-Tex, and is sold under Model No. Bonpel 0.031. It is available from Bontex Corporation, which is located at Buena Vista, Va. 24416. This is generally a paper type of composition, it adds stability to the insert at this location, it facilitates the application of the insole insert into the footwear, and can actually be adhesively applied therein, if the wearer desires to obtain permanent installation of the insole of this invention into his/her shoes, upon application.

The various laminar layers for this invention usually may be molded together, during fabrication of this insole, or they may be adhesively applied together, through a step-by-step laminar application during their fabrication. The moldable and contourable layer 6, as previously explained, may be applied to the final paper layer 7 by means of any formulated adhesive, used in the footwear art, for this purpose. For example, an adhesive such as "23'20'8", available from Midwest Industrial Chemical, and which is located at St. Louis, Mo., formulates special adhesives for footwear manufacturing purposes.

Figure 3:
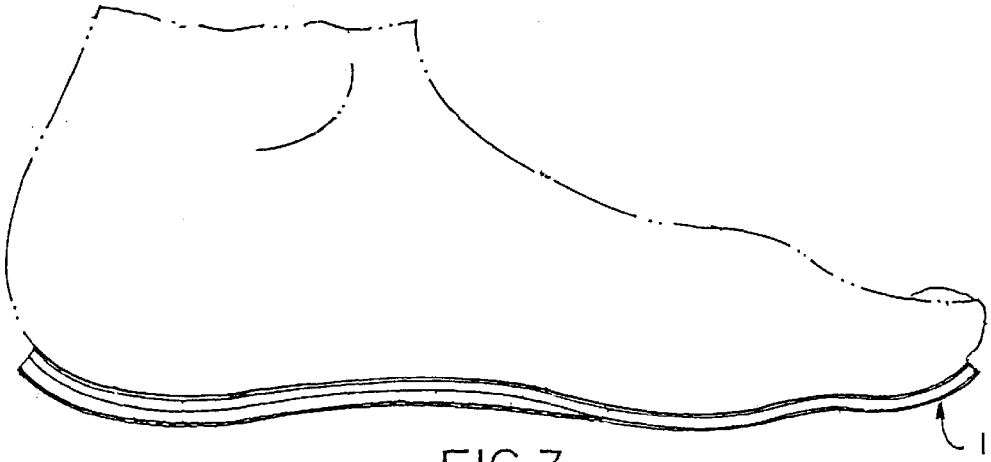
FIG. 3 is an illustration of how the foot when applied to the insole insert of this invention, after the insert has been heated, conforms the insole to the contours and and configuration of the shape of the undersurface of the foot, during application.

An example as to how the insole insert of this invention may be applied, during installation, can be seen in FIG. 3. As disclosed, the insole insert 1 having the various laminar layers as previously described, is shown being subjected to the pressure of the foot, during its application. Usually, the insert before having been applied into a shoe, will have been previously subjected to heat, such as that of the microwave oven, within the temperature range as previously specified, and then applied into the shoe, after which the foot is located therein, and pressure applied, to contour the insert in the manner as shown herein. Thus, the previously described fabric layer 6, as can be seen, which extends from the back or the heel portion of the insole, to approximately just short of the ball section of the foot, will undertake and conform to the pressure of the foot applied thereon, and thermoset to that configuration, compatible with the undersurface of the foot, as can be noted. It can be seen that particular layers of the insert, such as the closed cell foam layer 5, and the polymer woven strand layer 6, do only extend partially towards the front of the insert, since most of the impacting pressure applied to the foot, and where the contouring is desired for this particular insert, is from the heel portion of the insert, forwardly to the approximate ball of the foot, as can be noted.

Figure 4:
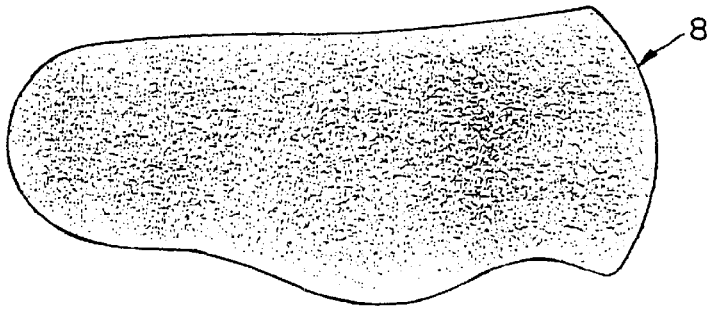
FIG. 4 shows a half sole form of insole insert for this invention.
Figure 5:
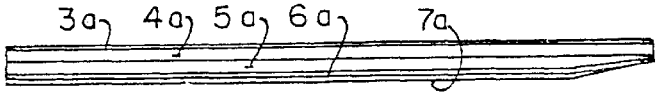
FIG. 5 shows the laminar relationship of the various layers that make up the modified insole insert of FIG. 4.

A modification to the insole insert of this invention is also disclosed in FIGS. 4 and 5. The insert 8 as shown herein, extends just to that portion behind the ball of the sole of the foot, as can be seen. It is a half form of insole insert, as noted. The laminar layers that make up the insert of this invention, as can be seen in FIG. 5, are similar and identical to those as previously described in FIG. 2, but they only extend for the limited distance as previously explained. For example, there is an upper microfiber layer 3*a*, that forms the upper surface of the insert, and fabricated as previously explained for the component 3. The second layer is the same type of urethane type of foam, as can be noted at 4*a*, sold under the previously identified trademark PORON. The third layer is the closed cell type of foam, as noted at 5*a*, and is the SCC closed cell foam layer, as previously described. The next lower layer is the woven polymer strand fabric, as noted at 6*a*, and sold under the Model No. R-3101, as previously reviewed. Finally, the bottom layer 7*a* is the Bond-Tex material, is of a paper, or perhaps polymer, composition, and which is that layer which is rested upon, or adhered to, the upper interior surface of the midsole portion of the formed sole for the fabricated shoe in which this insert applies.

As a further variation to the subject matter of this invention, the layer 5, or the cover material presently identified as microfiber, which possesses memory when heated, can be modified or substituted by several other products. Essentially, though, the major consideration in the use of equivalent products is that it must have 15% to 20% elongation or stretch capabilities, during the molding process, as previously explained. For example, an alternative product is available from Textron, marketed under Model No. E41AA, and can be used to replace or substitute for the STANBEE material as previously identified. Its basic application in the insole remains the same, but the microwave heating time, and perhaps the temperature, may vary slightly.

In addition, the adhesive for this insole has been reformulated to provide better water and moisture resistance, and yet allows it to activate appropriately when heated in the microwave.

Furthermore, this product can be expanded to include a variety of different components, in its structure, such as moldable heel pads, in addition to moldable sole components, or may include three-quarter length inserts and other special need type pads.

Variations or modifications to the subject matter of this invention may occur to those skilled in the art upon reviewing the disclosure as provided herein. Such modifications, if within the spirit of this development, are intended to be encompassed within the scope of this invention. The description of the preferred embodiment as provided herein, and as shown in the drawings, is set forth for illustrative purposes only.

What is claimed is:

1. An insert for a shoe including at least one layer of thermosetting polymeric material, said thermosetting polymeric material capable of being deformed and molded when subjected to the weight of the foot of the wearer, after said polymeric material is subjected to heat, said polymeric material thermosetting at least once when the temperature of said material is raised to a temperature greater than that of ambient temperature, said insert including a bottom layer having a shape conforming to that of the interior of a shoe, said one layer of thermosetting polymeric material being applied onto said bottom layer, said thermoplastic material layer comprising a strand of woven fabric of thermoplastic material which when subjected to heat and pressure of the foot undertakes the particular configuration and shape of the foot as the molding component applied thereto during application, a layer of material comprising a foam of polymer having impact resistance, applied to said one layer of thermosetting polymeric material, said layer of foam of polymer provided to add cushioning and shock absorbing to the insert and to provide resiliency and comfort to the shoe during usage and application.

2. The insert of claim 1 wherein said thermosetting polymeric material includes a layer of foamed polymer, and a contiguous layer of woven strands of polymeric material forming the thermosetting material of the insert.

3. The insert of claim 2 and wherein said polymeric material capable of thermosetting when subjected to heat in the range of 130° F. to 190° F.

4. The insert of claim 2 wherein one layer of thermosetting polymeric material extends less than the length of the shoe insert.

5. The insert of claim 2 wherein said contiguous layer of woven strands of the layer of thermosetting polymeric material comprises strands of one of cotton and nylon, saturated with a thermoplastic polymer, to provide said strands with a fabric-like woven consistency, providing for their thermosetting to a particular shape when subjected to heat and pressure.

* * * * *